United States Patent [19]

Sauerman et al.

[11] Patent Number: 4,784,206

[45] Date of Patent: Nov. 15, 1988

[54] SAND VIBRATION AND COMPACTION APPARATUS AND METHOD

[75] Inventors: Robert G. Sauerman, Euclid; Russell Shimandle, Jr., Seville; Gregory Piontkowski, Parma; Matthew A. Baca, Northfield; Donald L. Southam, Brecksville, all of Ohio

[73] Assignee: Combustion Engineering, Inc., Windsor, Conn.

[21] Appl. No.: 128,063

[22] Filed: Dec. 3, 1987

[51] Int. Cl.[4] ..... B22C 15/10

[52] U.S. Cl. ..... 164/18; 164/34; 164/39; 164/154; 164/203; 164/456; 366/114

[58] Field of Search ..... 164/39, 34, 35, 36, 164/18, 192, 194, 203, 206, 154, 456; 366/114

[56] References Cited

U.S. PATENT DOCUMENTS

| | | | |
|---|---|---|---|
| 3,767,168 | 10/1973 | Dupré et al. | 164/203 X |
| 4,593,739 | 6/1986 | VanRens et al. | 164/34 |
| 4,600,046 | 7/1986 | Bailey et al. | 164/34 |
| 4,685,504 | 8/1987 | Bond et al. | 164/34 X |

FOREIGN PATENT DOCUMENTS

| | | | |
|---|---|---|---|
| 54-35825 | 3/1979 | Japan | 164/203 |

*Primary Examiner*—Nicholas P. Godici
*Assistant Examiner*—J. Reed Batten, Jr.
*Attorney, Agent, or Firm*—Chilton, Alix & Van Kirk

[57] ABSTRACT

A compaction unit (12) having a frame (14) resiliently mounted to a rigid support (10), the frame rigidly supporting a molding flask (24) therein, and having at least one pair of synchronized motors (A) with eccentric rotors coupled to the frame for vibratory motion therewith. The motor pairs are synchronized in counter rotation so that a given pair produces a net force vector perpendicular to a line joining the motor pair. Preferably, three motor pairs (A, B, C) for driving the frame in three different axis, are controlled by a program which permits sequential specification of the duration and net vector acceleration, over a wide range of values. The motors are maintained in synchronized phase relationship during the changeout of flasks, so that the compaction vectors experienced by each flask begin from the same initial idle condition.

39 Claims, 7 Drawing Sheets

SAND VIBRATION AND COMPACTION APPARATUS AND METHOD

BACKGROUND OF THE INVENTION

The present invention relates to a molding or casting apparatus, and more particularly to a system and method for vibrating and compacting sand about a molding pattern in a molding flask.

In the evaporative pattern casting technique, sand is fluidized and compacted around an expendable pattern in order to establish a cavity for the casting process. A vibration device of some type is typically employed in this process to achieve fluidization of the sand so that the sand more easily enters internal passages A vibration device is similarly used to compact the sand, once it has reached all the interior surfaces. After compaction, molten metal is poured into a sprue and the liquid metal vaporizes the pattern and thus accurately replicates the pattern.

Conventional compaction devices have typically been in the form of a vibrating table. A box or flask containing the sand and expendable pattern is set on or clamped to the table. Alternatively, the flask has been supported in a guided but free-floating position relative to the vibrating table. Experience with such prior art vibrating devices, particularly when more than one axis of vibration is actuated, has revealed several deficiencies. One deficiency is the lack of synchronization of the plurality of eccentrically weighted rotors, which produces force vectors in an uncontrolled orientation to the desired pure vertical or horizontal motions Also, the applied horizontal force vectors have been eccentric to the center of gravity of the flask and sand resulting in turning moments which give substantially different motions to the sand at the top of the box than that experienced at the middle or bottom of the box. Both the lack of control of the force vectors and the turning moments tend to produce undesirable forces on the sand and pattern which can result in undesirable sand circulation irregularities and pattern distortion forces.

Another problem associated with prior art devices is the inconsistency among castings from identical patterns. Some of this inconsistency results from the problems mentioned above, but another contributing factor is the inconsistency in net vibrational forces on the flask during the initiation of each vibration cycle. In known systems, the synchronized motors or similar drive mechanisms, begin the vibration cycle from a "dead start". The initial forces acting on the flask, prior to all the motors reaching full speed, varies almost randomly from pattern to pattern.

One embodiment of a conventional device is disclosed in U.S. Pat. No. 4,593,739. This patent discloses a method and apparatus for packing sand around a mold pattern by vibration, in which the mold pattern is held in position in a mold flask in an unconnected relation to the mold flask. Sand is supplied to the mold flask to surround the mold pattern while the mold flask is vibrated to compact the sand around the pattern. The mold flask is shaken by an arrangement including a vibrator motor mounted on a compaction table and a connecting arm intermediate the table and the flask such that only horizontal forces are transmitted from the vibrator to the flask. Preferably, the connecting arm is situated such that the horizontal vibrational forces are directed in a horizontal plane extending approximately through the combined center of gravity of the mold flask and the sand.

A similar embodiment is disclosed in U.S. Pat. No. 4,600,046, wherein a molding apparatus comprising a rigid mold flask is adapted to contain a mold pattern and sand and when containing sand, has a combined center of gravity. A support is provided for resiliently supporting the mold flask for horizontal movement only of the mold flask as a whole body, and a vibrator shakes the mold flask to provide horizontal vibrational forces directed in a horizontal plane extending approximately through the combined center of gravity. This patent discloses the structural details associated with the horizontal vibration means referred to in the above-mentioned U.S. Pat. No. 4,593,739.

Although the systems illustrated in these patents provide certain improvements over older techniques, they are limited in the flexibility and control of the direction and magnitudes of the net vibrational force vectors which they can produce. Thus, they cannot take full advantage of the potential flexibility and degree of intricacy that the evaporative pattern process is capable of achieving.

SUMMARY OF THE INVENTION

Accordingly, it is an object of the present invention to provide a sand vibration and compaction apparatus which under predetermined operator control settings, can generate a plurality, preferably three, mutually perpendicular, oscillating force vectors acting through approximately the center of gravity of the loaded flask.

It is another object of the invention to simplify the mounting of the vibration means and support structure associated with such a mold flask, by eliminating the need for a compaction table between the vibrator means and the flask.

It is a further object of the invention to generate a sequence of different net force vectors through the approximate center of gravity of the loaded flask, in which the direction, the compaction frequency and thus force magnitude, and the time duration, of the net vectors are preprogrammed.

Additional objects of the invention are to provide a more direct coupling of rotary vibration means to the flask, and where vibration motor pairs are employed, to synchronize them with greater accuracy than was available with prior techniques. Such synchronization is accomplished even at the earliest moments during the startup of each vibration cycle.

It is yet a further object of the invention that the foregoing objects be accomplished in a system adapted for rapid throughput of a plurality of molding flasks, such that a given flask is automatically brought into coupling engagement with the vibrator means, the flask is vibrated as it is filled with sand, the sand is compacted as the flask fills, and that, after compaction has been completed, the flask is automatically uncoupled from the vibrator means and conveyed to a metal-pouring station or the like.

These objects are accomplished in one embodiment of the invention by a molding apparatus comprising a rigid mold flask adapted to contain a mold pattern and sand, and a frame including clamping means for selectively rigidly connecting the frame to the flask. The frame is resiliently mounted to a rigid support, such as by airbags. A first pair of vibration motors is provided, each motor having a drive shaft for rotation about a body shaft axis and having weights mounted for eccentric rotation about the shaft axis. The pair of motors are dynamically coupled and mounted on the frame for movement with the frame. The motors are synchronized in counter rotation, whereby the rotation of the eccentric weights produces a first oscillating horizontal force vector operating normal to the centerline passing through the first pair of motors. On a rectangular frame, the motors are preferably mounted in opposite corners and the force vector operates in a direction diagonally across the other opposed corners of the frame. Alternatively, the motors of the first pair can be mounted to the same corner of the frame.

Preferably, a second pair of motors is also mounted to the frame for movement with the frame, in a dynamically coupled manner similar to the first pair of motors, but on the other corners of the frame, for producing a second horizontal force vector normal to the first force vector. Additionally, a third pair of motors synchronized in counterrotation, is mounted for movement with the frame to produce a third force vector, in the vertical direction. Preferably, the first, second and third force vectors all pass substantially through the center of gravity of the loaded flask.

In the preferred embodiment, the frame has a vertical axis and is shaped so that the center of gravity of the frame falls on the vertical axis. The airbags permit limited horizontal and vertical oscillation of the frame relative to the support. The sand molding flask is rigidly supported within the frame and shaped such that the center of gravity of the flask when filled with sand lies within the frame substantially on the frame vertical axis. First, second, and third vibrators generate respective oscillating force vectors along a first horizontal axis, a second orthogonal horizontal axis, and the vertical axis. Each of the vibrator pairs is independently adjustable so that the magnitude and duration of the net force vector passing through the center of gravity of the loaded frame can be preprogrammed for controlled vibration and compaction duty.

This control feature is implemented in the preferred embodiment by sensing the rotation speed of each vibrating motor shaft, sensing the acceleration of the flask along each of the horizontal and vertical axes, and regulating the speed of rotation of each shaft based on the set point values for the magnitudes of the force vectors and the respective durations thereof, for each axis.

In general, the apparatus in accordance with the present invention preferably comprises a box-like frame structure in contrast to a table typical of the prior art. The frame structure is open on opposite sides to permit entry and exit of the flask in a horizontal direction. The structure has an opening at the top to permit the entry of sand into the flask during the vibration operation. A motor is located at each corner of the structure, for rotating eccentric weights about a vertical axis of rotation. The center of gravity of the eccentric weights is located approximately at an elevation which is substantially the same as the elevation of the center of gravity of the combined box structure, flask and sand. By means of proper power supplies, which could include synchronized motor drives, a closed loop induction motor with feedback on phase angle, or a mechanical, geared coupling, and by carefully controlling the phase angle of each motor with its associated eccentric weight, relative to the other motor, the resulting force vector can be controlled for consistency among castings using an identical mold pattern. In a similar manner, another pair of motors can be located at the sides of the structure, oriented in a horizontal plane. This pair of motors can be synchronized with one another with eccentric weights in such a manner as to produce a pure vertical force for excitation of the flask, sand and structure. By suitable electronic means, all three pairs of motors can be synchronized, thereby controlling the phase relationship of forces developed between mutually perpendicular axes. In the embodiment wherein the pair of motors are synchronized by gear connection therebetween, the motors are located adjacent each other, i.e. coupled to the same corner of the frame, or at the top or bottom symmetric relative to the vertical centerline of the frame.

The present invention thus overcomes the deficiencies of the known techniques in that a vibration in a series of predefined directions can be adjusted in magnitude and duration cycles, and can operate substantially through the center of gravity of the loaded flask or loaded frame, thereby providing great flexibility in compaction control, while avoiding inconsistent or undesirable turning moments on the sand.

BRIEF DESCRIPTION OF THE DRAWINGS

These and other features and advantages of the invention are described more fully below with reference to the accompanying drawings, in which.

DESCRIPTION OF THE PREFERRED EMBODIMENTS

Figure 1:
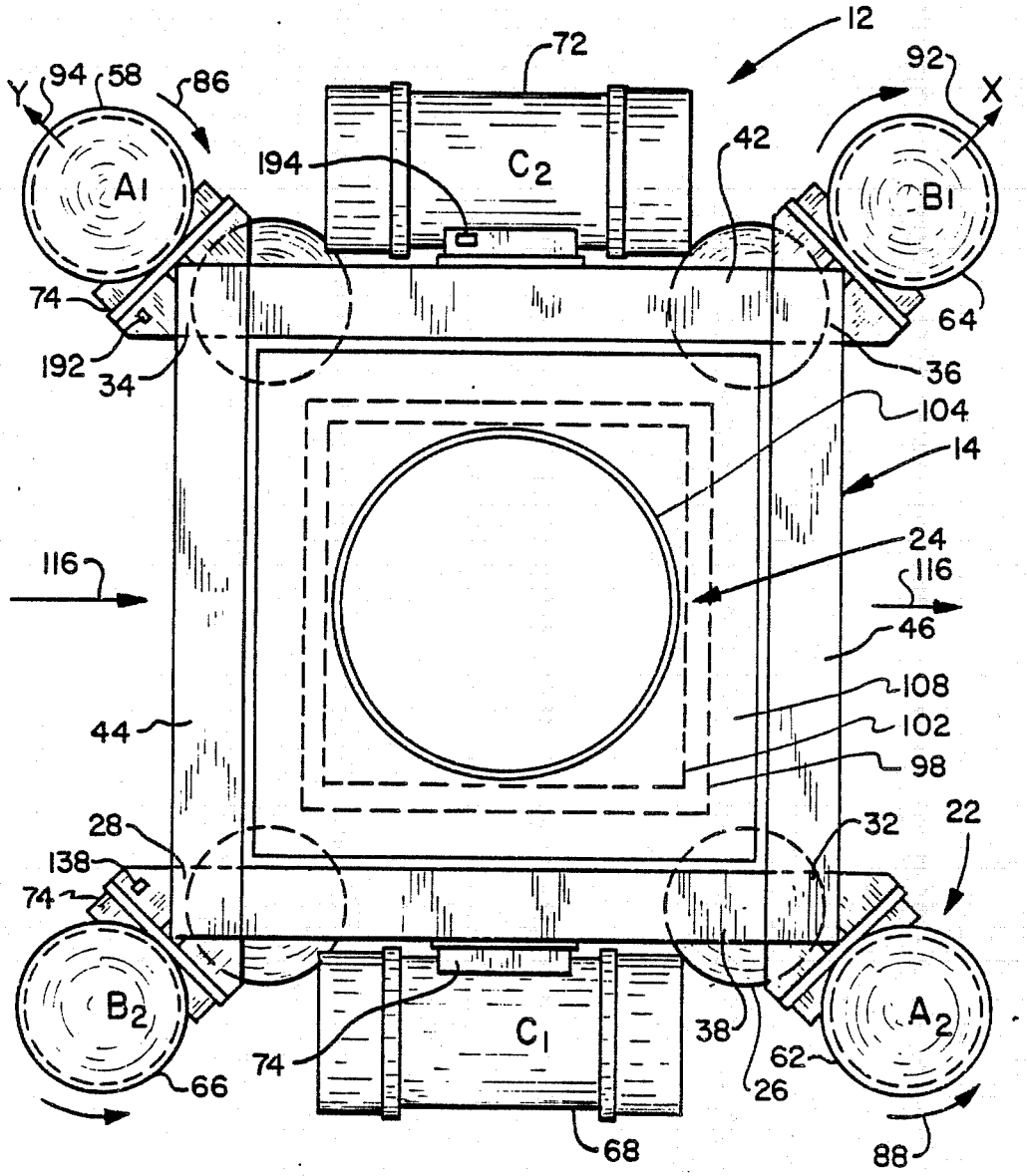
FIG. 1 is a plan view of the compaction unit, with the flask clamped therein.
Figure 2:
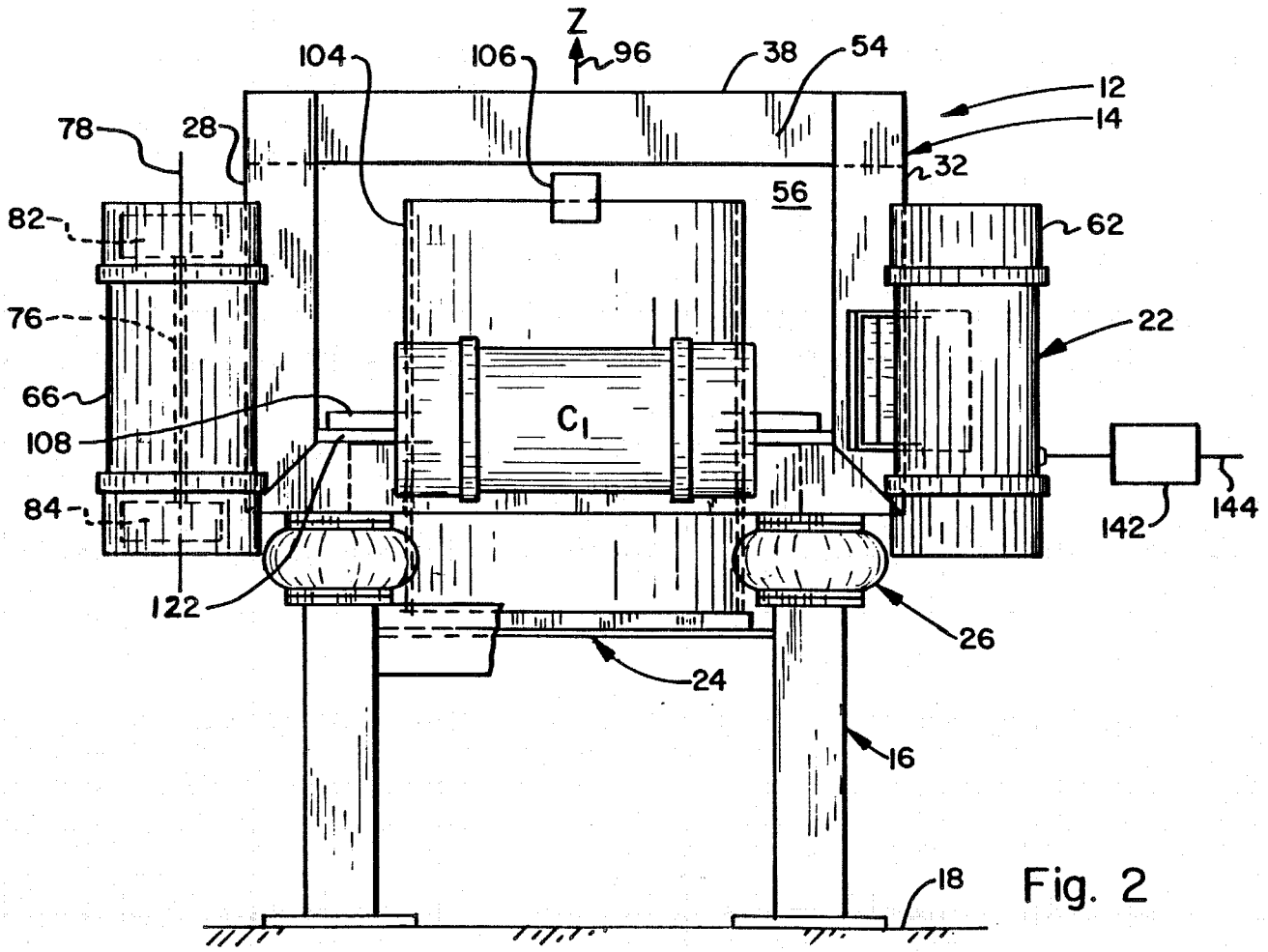
FIG. 2 is a front elevation view of the compaction unit of FIG. 1.
Figure 3:
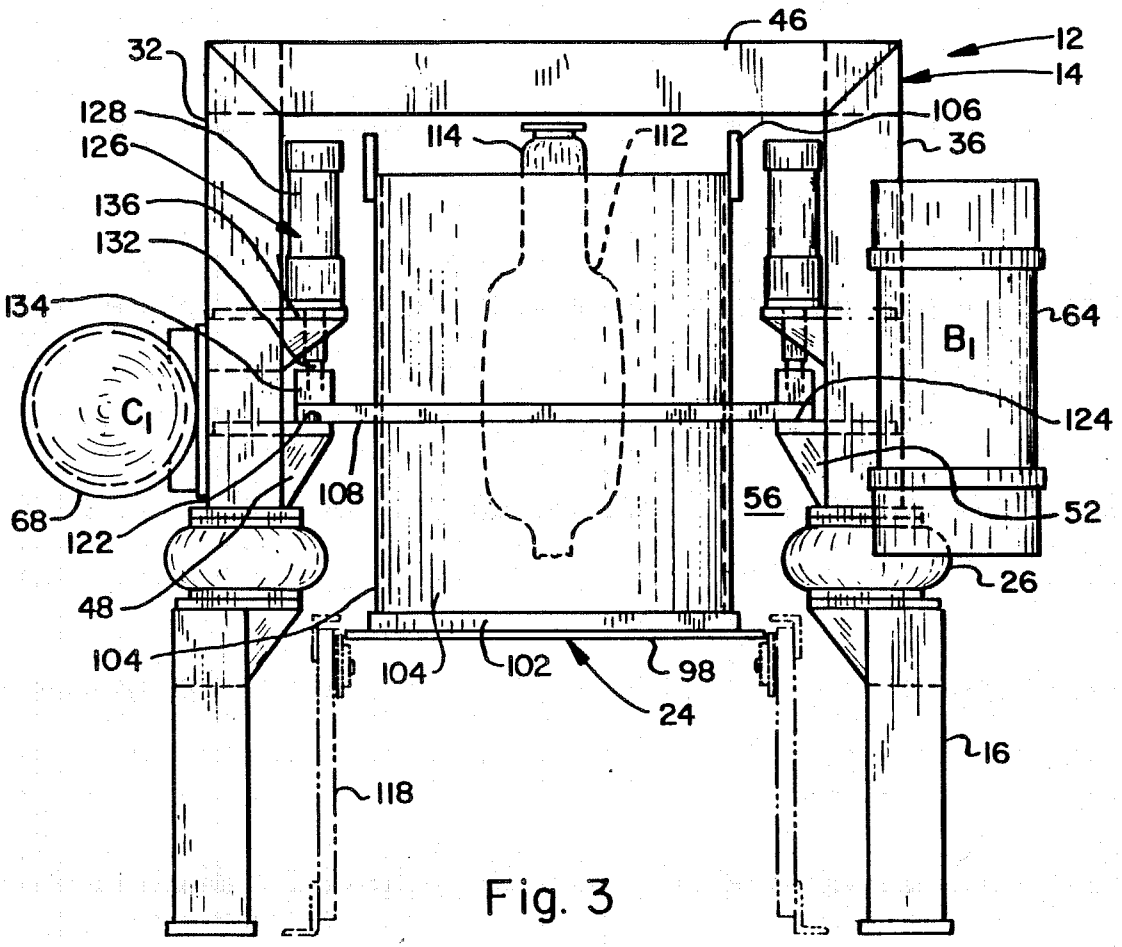
FIG. 3 is a side elevation view taken from the right of FIG. 2, with motor $A_2$ omitted for clarity.

FIGS. 1–3 illustrate a compaction unit 12 representing a first embodiment of the invention. The compaction unit comprises a number of major components including a box or frame 14 connected to a plurality of support legs 16 which are rigidly connected to and extend vertically from, a shop floor 18 or the like. The frame 14 includes a plurality of vibration motors 22 mounted on the frame for oscillating the frame while moving therewith. The frame 14 is adapted to receive and rigidly support a molding flask 24. The vibration of the frame 14 compacts the sand for purposes well known in this art. To permit vibration along multiple axis, the frame 14 is resiliently coupled to the support legs 16 by, preferably, air bags 26.

Although the frame 14 can take a variety of shapes, it preferably resembles a rectangular, upright space frame structure. The frame may optionally be enclosed at least to some extent, in which case it would resemble a box. For convenience in further describing the compaction unit 12, an arbitrary directional scheme will be used in which the meaning of the terms horizontal, vertical, front, back, left, right, top and bottom will become evident.

The frame 14 preferably comprises four vertical posts, including front left post 28, front right post 32, rear left post 34 and rear right post 36. At their tops, the front posts 28, 32 have a horizontally extending front brace 38 rigidly connected therebetween, and the rear posts 34, 36 have a rear brace 42 rigidly connected therebetween. Similarly, side braces 44 and 46 are rigidly connected at the tops of posts 28, 34 and 32, 36, respectively. Preferably rigid front wall or bar structure 48 and rigid rear wall structure 52 are provided, but it should be understood that, in the preferred embodiment, the lower portion of the left and right sides of the frame are unencumbered so that flasks can be passed through the sides of the frame sequentially. As is evident in FIG. 3, it is thus preferred that the frame 14 have a substantially inverted "U" profile when viewed from the side, thereby defining a channel 56 through which the flasks can be sequentially brought into and taken out of the frame 14.

In the illustrated embodiment a pair of motors A1, A2, having reference numerals 58, 62 respectively, are rigidly connected to posts 34, 32, preferably along a diagonal connecting opposite corners of the frame. Likewise, a second pair of motors B1, B2, having reference numerals 64, 66, respectively, are rigidly connected to posts 36 and 28, at the other opposite corners of the frame. Each motor A1, A2, B1, B2, is vertically mounted by means of any conventional bracket 74, such that the rotating shafts 76 thereof lie on a vertical shaft axis 78.

As shown in phantom in FIG. 2, each motor shaft 76 includes a pair of spaced apart, weighted, eccentrically mounted rotors 82, 84. When viewed in plan as shown in FIG. 1, the rotors of motor A1 follow a clock wise rotation 86, whereas the rotors of motor A2 follow a counterclockwise rotation 88. Each motor A1, A2 is synchronized so that they effectively lock into phase with the excitation fields from a common power source. Furthermore, the motors run at a variable speed which when set, can be considered absolutely constant. After proper initialization, the phase relationship between the eccentric weights of a given motor pair A1, A2, is closely maintained, until the motors are stopped or pulled out of synchronized operation by excessive loading.

As the eccentric weights rotate in their respective directions, the force components acting on the frame in the direction between the motors A1, A2, precisely cancel each other, with no net force being generated. However, the force components along the horizontal X axis 92 are additive (and symmetric when in phase) to produce an oscillatory motion of the frame along the X axis 92. With the frame fully loaded with a sand-filled flask 24, the induced vibration frequency can be selected within the broadest available range of motor speed, thereby generating the widest available range of acceleration (g). Likewise, the second pair of motors B1, B2 include synchronized counter rotating weights which generate a net force vector along the horizontal Y axis 94 which is orthogonal to X axis 92.

The third pair of motors C1, C2 having reference numerals 68, 72, are rigidly supported on front wall 48 and rear wall 52, and synchronized in counter rotation to generate a net force in the vertical direction, i.e., along the Z axis 96. As will be described more fully below, each of the first, second, and third motor pairs can be independently controlled as to the duration and frequency of rotation.

As shown in FIG. 3, the flask 24 preferably includes a square bottom plate 98 integral with a base 102, a cylindrical upright container portion 104, and one or more fittings 106 at the upper end of the container portion 104. The base plate 98 need not be a permanent part of the flask, but could instead be detachably associated with conveyor means 118 or the like which brings each flask sequentially within the frame 14. The fittings 106 can be of a type to facilitate handling of the flask during process steps preceding and following compaction, or of a type which facilitates positioning or coupling of a sand hopper or distribution box (not shown) on the flask for loading sand when the flask i with in the frame 14. For this purpose, the top 54 of the frame 14 is open, or if there is a top cover, it has an opening sufficient to receive the distribution box vertically therethrough.

A flange plate 108 circumscribes the container portion 104 intermediate the top and bottom of the flask, and is rigidly connected thereto. The flange plate is preferably square, and preferably has a linear side dimension greater than that of the base 102 and bottom plate 98. The location of the flange plate 108 intermediate the upper and lower ends of the flask, is chosen to be approximately at the elevation of the center of gravity of the flask when it is filled with sand and contains the mold pattern 112 (shown in phantom). As is well known in this art, the sand around mold pattern 112 is compacted during vibration of the frame, after which molten metal is introduced into the mold pattern 112 through a sprue 114.

It is thus evident that the flask 24 must be connected to the frame 14 before the motors begin strong vibrating action. In the preferred embodiment, a flask 24 is brought toward the compaction unit 12 along the conveyor direction 116 on any suitable variety of conveyor means 118. Before a given flask is brought within the frame channel 56, the air bags 26 are in a deflated condition. The conveyor 118 then brings the flask 24 horizontally through the left side of the frame 14 and locates the flask so that the vertical center lines of the flask and the frame are approximately coincident. The distance between the bottom plate 98, which at this point rests on the wheels of conveyor 118, and the lower edge of the flange plate 108, is predetermined so that the flange plate 108 is positioned above the channel front ledge 122, and channel rear ledge 124, which span the inside of the front 28, 32 and rear 34, 36 posts. A clamping device 126 is mounted in each corner of the frame, on the respective posts, and preferably includes a hydraulic cylinder 128 with a vertically displaceable plunger 132. A boss 134 or other structure adapted to mate with the plunger 132 is positioned preferably at each corner of the flange plate 108, such that when the plungers 132 are fully advanced, they engage recesses in the bosses 132, clamping the plate 108 rigidly relative to the frame 14. Each of the clamping devices 126 can be rigidly secured to a respective post by any type of conventional cylinder bracket 136. Before clamping of a flask 24 to the frame 14, the air bags are filled, lifting the bottom plate 98 from the conveyor means 118.

The compaction unit is then ready for vibration under operator control. The control system will be described more fully in connection with FIGS. 7–9, but to facilitate the later understanding thereof, FIGS. 1 and 2 show the positioning of an accelerometer 138 for measuring acceleration of the frame and flask along the X axis, and a motor controller 142 for controlling the first motor pair A1, A2 which produces the vibration along the X axis, the motors being powered through a line 144 from a three phase power source (not shown).

Figure 4:
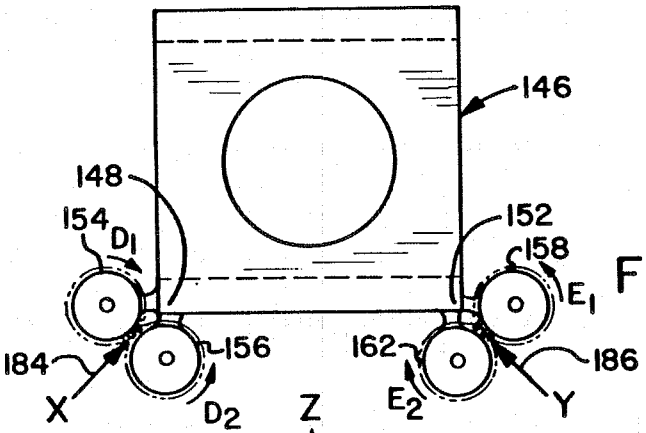
FIG. 4 is a plan view of an alternative embodiment of the invention.
Figure 5:
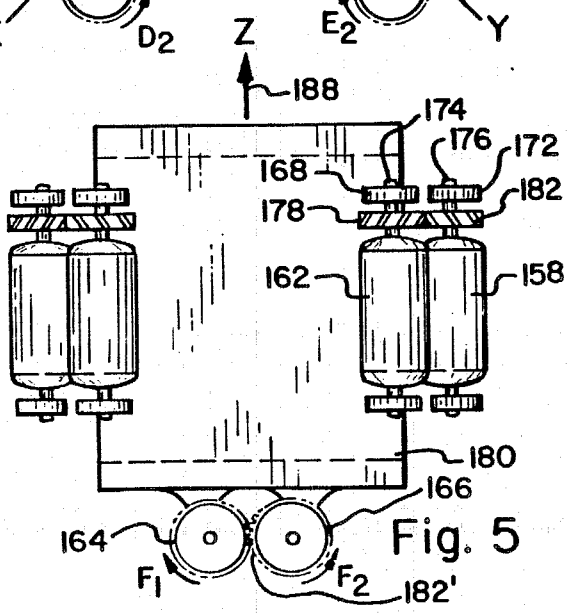
FIG. 5 is a front elevation view of the embodiment of FIG. 4.
Figure 6:
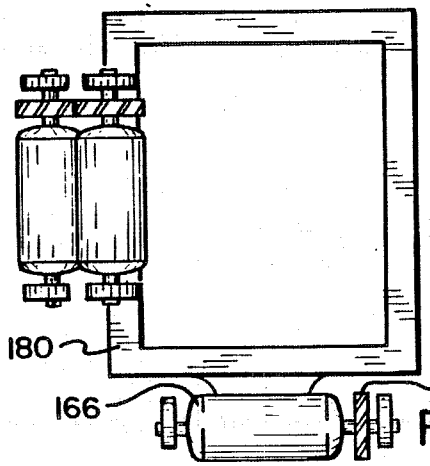
FIG. 6 is a side elevation view taken from the right of FIG. 4.

FIGS. 4, 5, and 6 illustrate an alternative embodiment of the invention, by which the force vectors along the X, Y and Z axes can be independently generated, similar to the actuation of the motors in the embodiment shown in FIGS. 1–3. In the alternative embodiment, the frame 146 is substantially similar to frame 14 shown in FIG. 1, but the front left corner 148 and the front right corner 152 support all four of the first and second pair of motors. The first motor pair D1, D2 represented by reference numerals 154, 156, are rigidly secured to the front left corner and the second motor pair E1, E2, represented by reference numerals 158, 162 are rigidly secured to the front right corner. The motors are similar to those described with respect to the embodiments represented in FIGS. 1–3 in that, for example, motor 162 has shaft 174 and upper rotor 168, motor 158 has shaft 176 and upper rotor 172. The rotors 172, 168 operate in counter rotation to produce a resulting net force vector in the horizontal direction normal to an imaginary line joining the center lines of the motors.

In the illustrated alternative, which is particularly well suited for absolute synchronization of each pair of motors, the shafts 174, 176 further include centered gears 178, 182 which mesh together and therefor mechanically maintain the initial phase relationship of the eccentricities in the rotors 168, 172. The geared motor pairs for the pair of D1, D2 and for the third pair of motors Fl, F2, having reference numerals 164, 166, can likewise be readily implemented.

The frame 146 in the alternative embodiment includes a floor 180 to which the third pair of motors F1, F2 are attached, on either side of the vertical center line of the frame, but in close parallel relation to permit the interengagement of the centered gears 182'. It may be appreciated that with the embodiments illustrated in FIGS. 4–6, the first pair of motors D1, D2 produces a net horizontal vibration along the X axis 184, the second pair of motors E1, E2 produces a net horizontal vibration along the Y axis 186, and the third pair of motors F1, F2 produces a net vibration in the vertical or Z axis 188.

In both of the illustrated embodiments, it is preferable that the center of gravity of the eccentric weights for a given motor pair, is located approximately at the same elevation as the center of gravity of the frame 14, the flask 24 including sand and mold pattern, and any other structure which may be rigidly connected to the frame 14 for movement therewith. With respect to the first and second pair of motors, $A_1$, $A_2$, $B_1$, $B_2$, $D_1$, $D_2$, $E_2$, $E_2$ in which the eccentric rotors are vertically spaced apart on a given axis, the center of gravity of each motor will be midway between the rotors of the given motor. The frame 14 is sized, and the flask 24 is clamped within the frame, such that the centers of gravity of the frame 14 and the flask 24 (and any associated structure), all lie on approximately the same imaginary plane at an elevation within the frame 14. Thus, the centers of gravity of the motor pairs should also be located approximately on this plane. In the illustrated embodiments, the center of gravity of the combination of the loaded frame (i.e., including structure and loaded flask) lies at an elevation intermediate the vertical ends of the first and second pair of vibrator motors and on the Z axis 96, 188.

The location of the center of gravity of the third pair of motors, $C_1$, $C_2$, $F_1$, $F_2$ for generating the vertical force vector, need not be near the horizontal plane associated with the centers of gravity of all motors A, B, D, and E, the frame and the flask, so long as the third pair of motors are symmetrically positioned 180° apart relative to the vertical line passing through the center of gravity of the loaded frame, e.g., preferably Z axes 96, 188.

It should be appreciated that a key feature of the invention is the rigid coupling of the vibrator means to the flask for movement therewith, with the respective centers of gravity aligned, for generating three mutually perpendicular oscillating vectors through the centers. The disclosed frame is a convenient structure for coupling the motors to the flask, but other functionally similar arrangements are possible.

Figure 7:
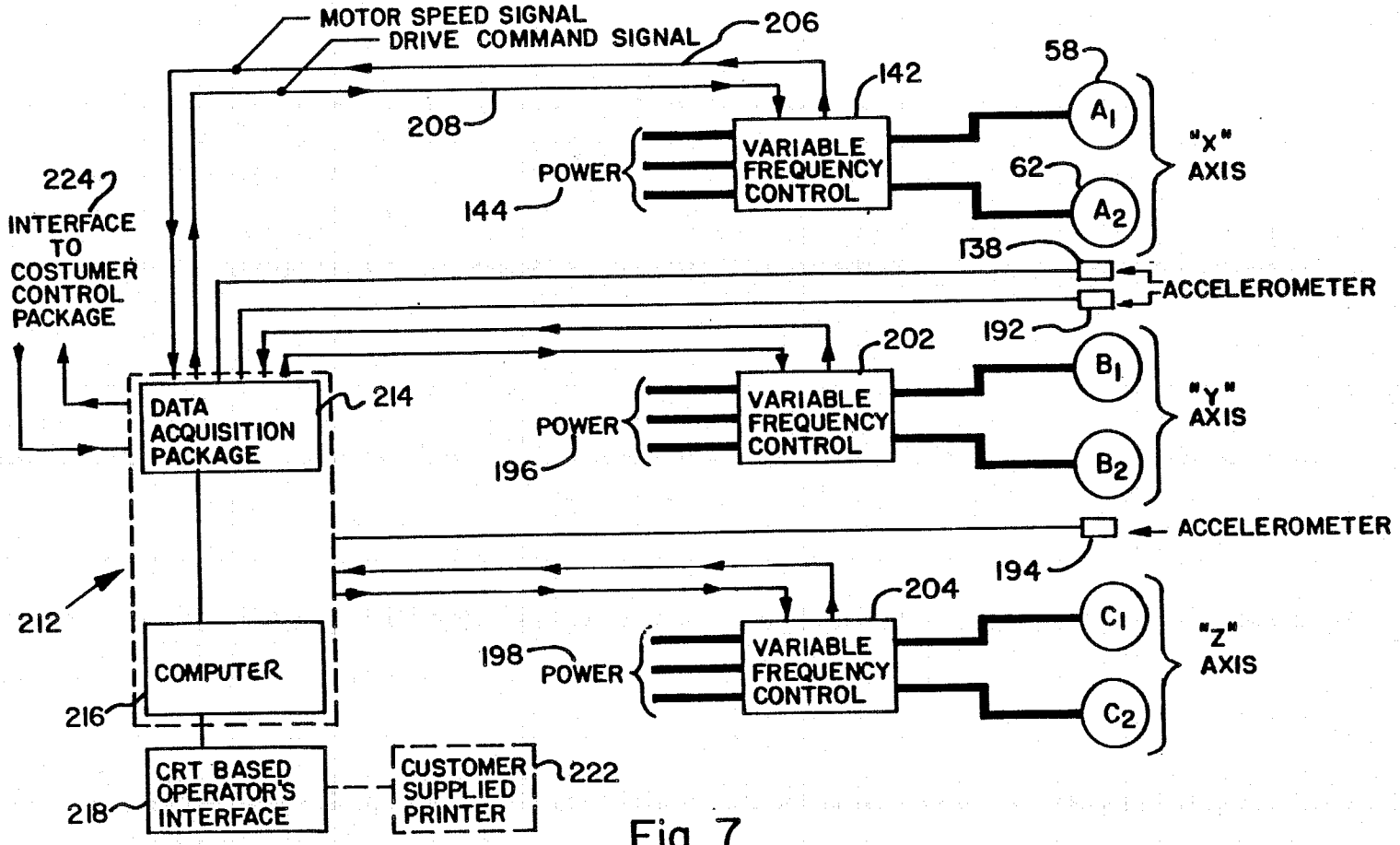
FIG. 7 is a schematic of the control system associated with either embodiment of the invention.
Figure 8:
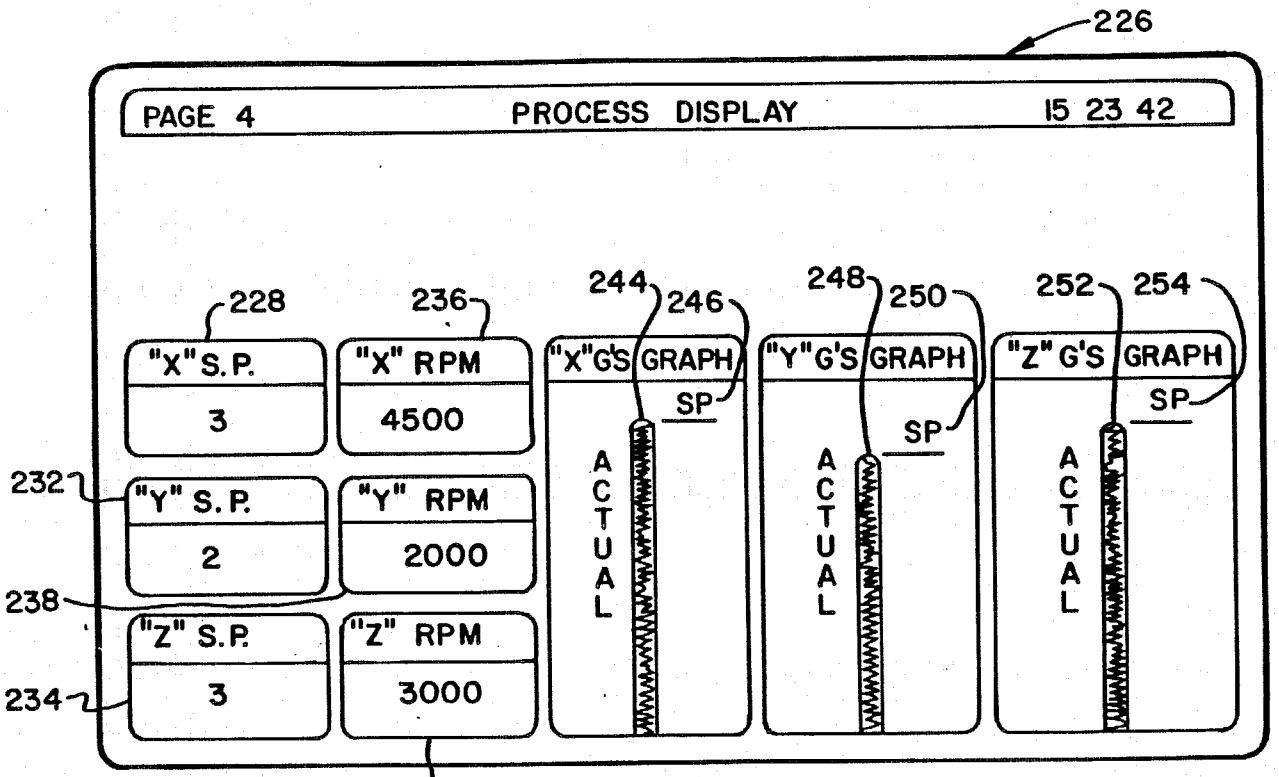
FIG. 8 is a schematic of the operator's screen display associated with the control system of FIG. 7.
Figure 9:
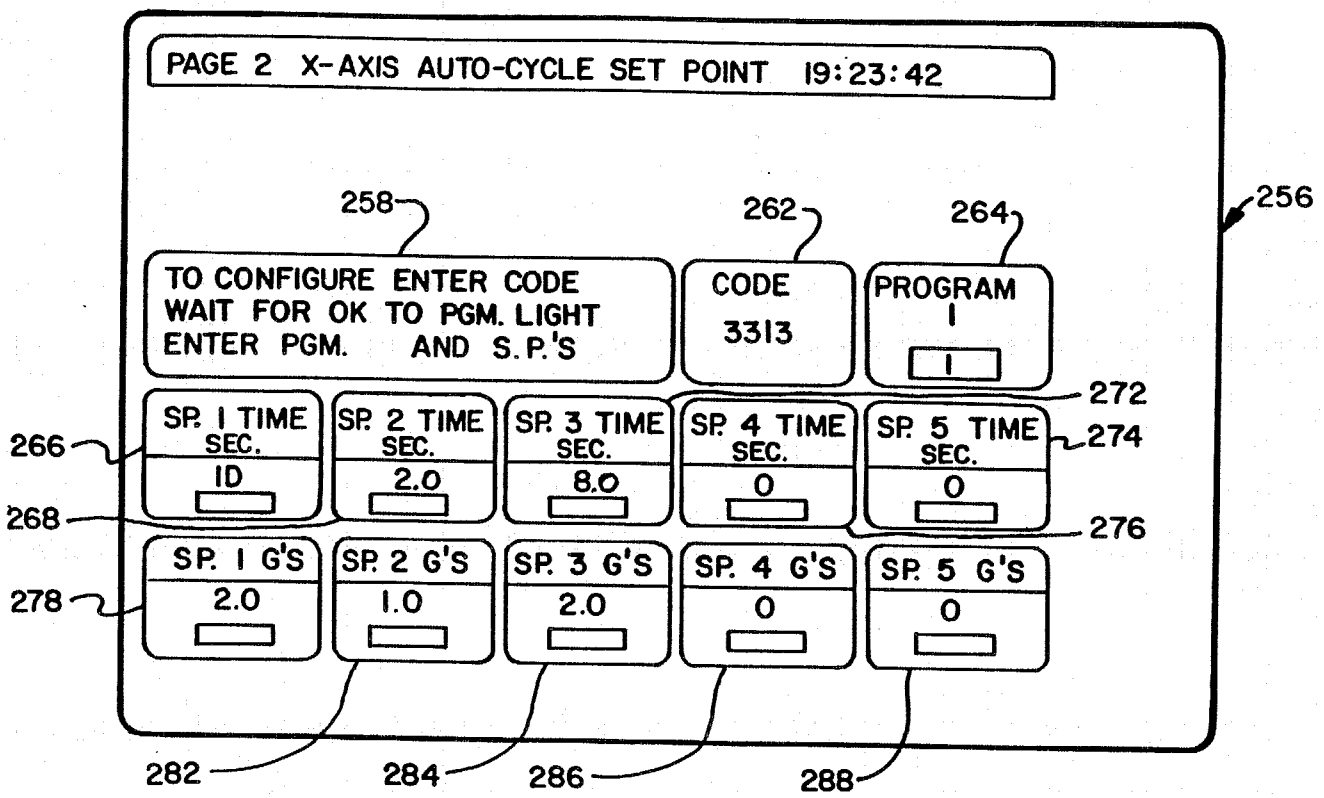
FIG. 9 is a schematic of a typical keyboard through which the control system of FIG. 7 is configured.

FIGS. 7, 8 and 9 provide a schematic illustration of the preferred control system associated with the compactor unit of either embodiment described above. FIGS. 1 and 7 show the accelerometer 138 for first motor pair A1, A2, and that second motor pair B1, B2 has an accelerometer 192 associated therewith for detecting acceleration in the horizontal Y axis, and the third motor pair C1, C2 has an accelerometer 194 for detecting vertical acceleration. Also, the second motor pair has a second power source 196 and the third motor pair has a third power source 198, similar to power source 144 described previously in connection with the first motor pair. Likewise, controllers 142, 202 and 204 are associated with the first, second and third motor pairs, respectively. The controller 142 for the first motor pair generates a motor speed signal on line 206, and receives a drive command signal on line 208, for measuring and controlling the vibration rate along the X axis. Likewise, the controllers 202, and 204 have similar, but independent lines. The lines from and to the controllers 142, 202, and 204 originate and terminate in a data interface board 214 in computer system 212. The computer includes a CPU 216, which can be a microcomputer of the type available from the IBM Corporation or compatibles. An operator interface 218 can include a keyboard, key pad, and screen (not shown), or similar devices for communicating with the CPU 216. A printer 222 may also provide an auxiliary interface, and a further interface 224 to a master control system in the user's plant may be provided.

The control system for the present invention can take advantage of the accuracy and independence of the force vectors generated along three perpendicular axes passing through the flask. By suitable electronic connections of a type common in the field of motorized systems, all three pairs of motors can be synchronized and the phase relationship of forces developed in the X, Y and Z axes can be duplicated for each successive pattern.

FIG. 8 shows the kind of information preferably displayed to the operator during operation of the compaction unit. The screen 226 represents one of a variety of input and output menus that can be provided to the operator. This particular process display is associated with a controller configuration procedure which permits the definition of a compactor unit run programmed for up to five sequential cycles of control for each of the X, Y and Z axes. The preferred control parameters are acceleration (g) and duration (s) at that acceleration The computer contains well known correlations relating the motor pair rpm to acceleration, and the capability to compute the net force or acceleration on the flask from acceleration measured along the axes. For example, assume that Table 1 defines the axis vector set point sequence for a particular mold pattern:

TABLE 1

| Axis S.P. # | | | X | Y | Z |
|---|---|---|---|---|---|
| 1 | (duration) | s | 10.0 | 12.0 | 10.0 |
| | (acceleration) | g | 2.0 | 0.0 | 1.0 |
| 2 | | s | 2.0 | 8.0 | 6.0 |
| | | g | 1.0 | 1.0 | 1.2 |
| 3 | | s | 8.0 | | 4.0 |
| | | g | 2.0 | | 1.5 |
| Total duration | | | 20.0 | 20.0 | 20.0 |

In this example, it is desired that the X axis acceleration be maintained at 2.0 g's for 10 seconds, then be reduced to 1.0 g's for 2 seconds, then increased to 2.0 g's for 8 seconds. During the same period, i.e., starting from the same "time 0", the Y axis force vector is desired to produce 0.0 g's for 12 seconds, and then 1.0 g's for 8 seconds. Similarly, the desired Z vector should produce 1.0 g's for 10 seconds, 1.2 g's for 6 seconds, and then 1.5 g's for 4.0 seconds. The particular desired run has a total duration of 20 seconds. The X axis vector has three cycles, the Y axis vector has two cycles and the Z axis vector three cycles. As is shown in Table 2, the combination of the foregoing axis cycles produces a run having four cycles, with the duration of each run cycle and the acceleration values along each axis for that duration, entered in the appropriate column.

TABLE 2

| Run Cycle | Cycle Time Points | Cycle Duration | Acceleration Magnitudes (g's) X | Y | Z |
|---|---|---|---|---|---|
| 1 | 0 seconds | 10 seconds | 2.0 | 0.0 | 1.0 |
| 2 | 10 | 2 | 1.0 | 0.0 | 1.2 |
| 3 | 12 | 4 | 2.0 | 1.0 | 1.2 |
| 4 | 16 | 4 | 2.0 | 1.0 | 1.5 |
| | 20 | end | 0.0 | 0.0 | 0.0 |

FIG. 8 shows in windows 228, 232, and 234, that the run is utilizing the third X set point, the second Y set point and the third Z set point. As is derivable from Tables 1 and 2, this represents the condition of the compactor unit during run cycle 4, when it is desired that the X axis acceleration be 2.0, the Y axis acceleration 1.0, and the Z axis acceleration 1.5 g's. The display windows 236, 238 and 242 indicate that the first, second, and third pair of motors are running at 4500, 2000, 3000 rpm, respectively, to generate the desired g forces. The other windows in display 226 represent the X, Y and Z actual g's as bars 244, 248 and 252, respectively in a manner that can be compared with the X, Y and Z axes g set points 246, 250 and 254 respectively.

The display screen 256 shown in FIG. 9 illustrates one means by which the set point information shown in Table 1 can be entered into the memory of the computer 216. An instruction message may be displayed to the operator in window 258. The operator, using a keyboard or the like in the interface 218 then enters a code number representing a password or other authorization, and the number appears in window 262. The operator then specifies a program number, in this case number 1, which then appears in window 264. It should be appreciated that the entry of data could be made through touch sensitive switches or the like incorporated in the display unit. This particular display 256 is utilized to define the X axis set points, for example those shown in Table 1. The operator defines the first set point time duration, 10.0 seconds, in window 266, the second set point duration, two seconds, in window 268 and the third set point time duration, eight seconds, in window 272. Although two more set points may be defined in windows 274 and 276 for program 1, these remain 0 because the full 20 seconds of the X axis vibration associated with program 1, has been specified. In a like manner, the g's for the first set point is entered as 2.0 and appears in window 278, the value of 1.0 for the second set point is entered and appears in window 282, and the third set point value of 2.0 is entered and appears in window 284. Zero's are then entered for the remaining, unneeded set points three and four, as appear in windows 286 and 288.

It should be appreciated that the computer system receives the g force data and displacement data from the accelerometers and the motor speed data from a frequency signal associated with the AC drive. The computer processes the data, compares the motor speed and the acceleration to the set points required during a particular cycle of the program specified for the run, and sends the appropriate command signals through the leads back to the AC drive to affect the desired cycle operation.

The ideal sequence of compaction vectors for obtaining satisfactory sand compaction for a given pattern supported within a given size flask, cannot readily be determined a priori. In practice, the determination of the run cycle, such as shown in Tables 1 and 2, is accomplished empirically, i.e. through trial and error. Each test run is recorded as to the axis set points and run cycle information of the type shown in Tables 1 and 2, and the sand compaction assessed. The present invention affords two advantages in this empirical determination. First, the precise compaction vector sequence that was utilized in a given run is known and adjustments can be made relative to any prior run by simple data entry steps in the controller. Secondly, once a satisfactory run cycle has been found, it can be precisely repeated for a production run of any number of substantially identical flasks and associated patterns.

The initial starting positions of the eccentric weights on the vertically oriented motor pairs, for generating the horizontal X and Y axis vibrations, are manually set using a removable crank inserted through the motor cover plate (not shown). The vertical axis eccentric weights will naturally be in the correct position due to gravity. An indicating light based on proximity sensors in the motor cover plates will indicate proper positions on all motors for starting. Once started, the motor pairs will synchronize and will not be shut off during normal operation. The motor pairs will be run at an extremely low idle speed between cycles or when a particular axis is not used. The ramping rate associated with actuation of a motor pair from the idle state, is manually adjustable at the AC drive. The control logic within the computer can take into account the ramping time, and, preferably, exclude the ramping from the duration of vibration along a particular axis as specified by the set point.

An important feature of the present invention depends on the capability of maintaining the motor pairs in synchronized phase relationship at low idle speed. This capability is utilized to assure that the initial ramping to a high speed vibration vector begins from a substantially identical initial condition, for each of the plurality of sequential flasks and associated patterns that are processed in the compaction unit.

A preferred method of operating the sand molding compaction system having a plurality of substantially identical rigid mold flasks, each adapted to contain a substantially identical mold pattern, will now be described in greater detail. The description can begin at an arbitrary point during the sequential filling and compacting of a plurality of flasks conveyed in a line into and out of the frame 14, as viewed in FIGS. 1–3. After compaction of an arbitrary first flask, the flask 24 is disconnected and removed from the frame 14. All motors A, B, and C continue to operate in synchronized, phase relationship at a low idle speed, thereby continuing to vibrate the frame 14 slowly. When the next, or second flask is located within the frame, the flask is rigidly connected to the frame while the frame is vibrating slowly. The mold pattern 112 is supported within the flask 24 by any of a variety of techniques, but preferably independently of the flask 24. Sand may then be deposited into the flask until it surrounds the pattern, at which point one or more motor pairs A, B, or C is ramped to a relatively high speed oscillation to generate an oscillating net compaction force vector on the frame, for compacting the sand around the pattern in the flask. The ramping for generating the high speed net compaction force vector can begin any time after the start of the deposition of sand into the flask. Thus, the filling and compaction of the sand can occur substantially simultaneously.

The initiation of the ramping to generate the net compaction force vector for each sequential flask is timed to begin precisely at the same point in the shaft rotation of each of the motors A, B, and C during the slow speed, idle mode. In this manner, the sequence of compaction vibration forces acting on the flask, sand, and pattern are substantially identical for each of the plurality of flasks and patterns that are processed through the frame. In the preferred embodiment, three pairs of motors A, B, and C each generate a mutually perpendicular vector through an imaginary set of axes through the frame, but the method as described above is equally beneficial in a system having only one pair of motors generating a compaction vector along a single direction.

The operating principles associated with the apparatus and method of the present invention, although preferably utilized in the field of sand mold compaction, are readily adaptable for use whenever a container is to be filled with compacting material to surround an object within the container, for example, prior to shipping.

Similarly, the shapes and size relationships of the various components as illustrated and described above, can be altered without departing from the scope of the invention. For example, the frame is shown as a rectangular, box-like member, but it could be a cylinder or have less structure than illustrated. Generally, it is desirable to minimize the extra weight associated with the frame, because this weight must be excited by the motors. If the flask is structurally robust, the frame can be no more extensive than that necessary to provide connecting structure to the flask and support structure for connection to the vibrating motors.

Functional substitutes can also be made without departing from the scope of the invention. Although synchronous motors are preferred, other types of motors, which include resolvers on the shafts and control motors to rotate the shafts at the same speed and phase angle (for a given motor pair), could also be utilized.

It should be appreciated that the invention described herein provides numerous advantages over known compaction units and techniques. A virtually infinite compacting program can be defined, customized to the shape of the mold pattern, as a result of the ability to actuate and control the acceleration of the loaded frame independently, in each of three mutually perpendicular axes. Moreover, the acceleration vectors along these axis operate through the approximate center of gravity of the loaded frame, which results in the virtual elimination of undesirable forces on the sand and pattern which, in the prior art, can result in sand circulation patterns and pattern distortion forces with undesirable affects on the casting product. Also, the compaction unit in the preferred form, is adapted to cooperate with a conveying system by which the sequential flasks are easily passed into and out of the frame, and clamped thereto in an efficient, simple manner. Furthermore, the frame has an opening at the top to permit the entry of sand to the flask during the sand filling operation and further permits filling while compacting.

It should further be appreciated that, although many advantageous features of the invention have been described in connection with a preferred embodiment, the simultaneous utilization or combination of such features is not absolutely necessary, in that subcombinations thereof fall within the scope of the claims as appended hereto.

We claim:

1. A unit for compacting packing material in a container, comprising:

a container having a center of gravity when filled with packing material;

means for resiliently supporting the container above the ground;

vibrator means coupled to the container for generating three mutually perpendicular, oscillating force vectors acting through the center of gravity of the container.

2. The compaction unit of claim 1, wherein said vibrator means has a center of gravity that substantially coincides with the container center of gravity.

3. The compaction unit of claim 1 further including means for independently controlling the duration and magnitude of each of said force vectors.

4. The compaction unit of claim 1, wherein the unit is a sand molding compaction unit, the container is a flask, and the packing material is sand.

5. A sand molding compaction unit comprising:

a frame having a vertical axis and shaped so that the center of gravity of the frame falls on the vertical axis;

means for resiliently connecting the frame to a rigid support, to permit limited horizontal and vertical oscillation of the frame relative to the support;

a sand molding flask rigidly supported within the frame and shaped such that the center of gravity of the flask when filled with sand lies within the frame substantially on the frame vertical axis;

first vibrator means for generating an oscillating force vector on the frame along a first horizontal axis passing through the center of gravity of the flask;

second vibrator means for generating an oscillating force vector on the frame along a second horizontal axis orthogonal to the first axis, passing through the center of gravity of the flask;

third vibrator means for generating an oscillating force vector on the frame along said vertical axis; and means for independently controlling the magnitude and duration of the force vectors generated by the first, second and third vibrator means.

6. The compaction unit of claim 5 wherein the sand in a given flask is to be compacted during a programmed run and wherein the means for independently controlling the force vectors include means for defining a plurality of sequential set points on the duration and magnitude of each force vector during said programmed run.

7. The compaction unit of claim 6 wherein the means for controlling the force vectors include means for operating each vibrator means for a plurality of sequential cycles, each cycle defined by a force vector magnitude and time duration at said magnitude.

8. The compaction unit of claim 7 wherein the first, second and third vibrator means each include means for rotating a shaft and associated eccentrically mounted weight, and wherein the means for controlling include means for sensing the rotation speed of each shaft, means for sensing the acceleration of the frame in each of three mutually perpendicular horizontal and vertical axes, means for computing the magnitude of the total net force acting on the sand in the flask as a function of the sensed rotation speed of each shaft and means for regulating the speed of rotation of each shaft based on the magnitude of the force vector set points for each axis

9. The compaction unit of claim 5 wherein said first vibrator means includes a first pair of motors having vertical shafts turning in synchronized counter rotation and said second vibrator means includes a second pair of motors having vertical shafts turning in synchronized counter rotation

10. The compaction unit of claim 9 wherein said frame includes four vertical corner posts and each motor of the first and second vibrator means is coupled to one of said posts

11. The compaction unit of claim 10 wherein the first motor pair is coupled to the frame so that the first horizontal axis extends between a first pair of opposite corner posts and wherein the second motor pair is coupled to the frame so that the second horizontal axis extends between a second pair of opposite corner posts

12. The compaction unit of claim 5 wherein the first horizontal force vector is in a direction normal to a line joining the first pair of motors and the second horizontal force vector is in a direction normal to a line joining the second pair of motors.

13. A molding apparatus comprising:

a rigid mold flask adapted to contain a mold pattern and sand;

a rectangular frame including means for selectively rigidly connecting the frame to the flask;

means for resiliently mounting the frame to a rigid support;

a first pair of motors, each motor having a drive shaft for rotation about a shaft axis and a weight mounted for eccentric rotation about the shaft axis, the pair of motors being coupled to the frame for movement with the frame; and first means for synchronizing the motors in counter rotation whereby the rotation of the eccentric weights produces a first force vector normal to the imaginary center line passing through the shafts of the first pair of motors, in a direction diagonally across opposed corners of the frame.

14. The molding apparatus of claim 13, wherein each motor of said first pair of motors is mounted on opposite corners of the frame.

15. The molding apparatus of claim 13, wherein the motors of said first pair of motors, are coupled to a first corner of the frame.

16. The molding apparatus of claim 13, wherein the means for rigidly connecting the frame to the flask, connects the frame to the lateral exterior of the flask.

17. The molding apparatus of claim 16, wherein the center of gravity of said first pair of motors lies substantially at the same elevation as said connection between the frame and the lateral exterior of the flask.

18. The molding apparatus of claim 13, wherein the mold flask includes a substantially square base portion, a vertically upwardly extending cylindrical portion open at its upper end, a flange portion intermediate the upper end and the base, and wherein said means for rigidly connecting the frame to the flask connects the frame to said flange.

19. The molding apparatus of claim 13, wherein said frame includes four vertical corner posts, front, back, left and right brace members interconnected at the upper ends of the posts, and wherein said means for resiliently mounting the frame to the rigid support is connected to the lower ends of said posts.

20. The molding apparatus of claim 19, further including parallel front and rear bars supported by the posts, and wherein said front and rear bars include means for vertically supporting said flange when a flask is located within said frame.

21. The molding apparatus of claim 20, wherein said means for rigidly connecting the frame to the flask, includes a plurality of hydraulically actuated clamping devices for clamping said flange against said means for vertically supporting said flange.

22. The molding apparatus of claim 13, wherein each motor of said first pair of motors is connected to one of said posts, with the respective motor shaft axes vertically aligned in parallel.

23. The molding apparatus of claim 18, wherein each motor has a pair of eccentric weights, one at each vertical extremity of the motor drive shaft, and wherein the flange is connected to said frame at an elevation intermediate the upper and lower weights on each of said first pair of motors.

24. The molding apparatus of claim 14 further including a second pair of motors, each motor having a drive shaft for rotation on a shaft axis and a weight mounted for eccentric rotation about the shaft axis, said second pair of motors being coupled to the frame at a respective pair of opposite corners different from said first opposite corners for movement with the frame; and second means for synchronizing in counter rotation the second pair of motors whereby the rotation of the eccentric weights in said second pair produces a second force vector perpendicular to said first force vector.

25. The molding apparatus of claim 13 further including a second pair of motors each motor having a drive shaft for rotation on the shaft axis and a weight mounted for eccentric rotation about said shaft axis, said second pair of motors being coupled to the frame for movement with the frame; and second means for synchronizing in counter rotation the second pair of motors whereby the rotation of the eccentric weights in said second pair produces a second force vector perpendicular to said first force vector.

26. The molding apparatus of claim 15, wherein said first pair of motors is geared together for synchronous rotation to produce said first force vector in a direction from the first corner to the opposed corner of the frame.

27. The molding apparatus of claim 25, wherein said second pair of motors are coupled to a second corner of the frame, said second corner being adjacent to said first corner.

28. The molding apparatus of claim 25 further including a third pair of motors each motor having a drive shaft for rotation on a shaft axis and a weight mounted for eccentric rotation about said shaft axis, said third pair of motors being coupled to the frame for movement with the frame such that the third shaft axes are perpendicular to the first and second shaft axes, and means for synchronizing in counter rotation the third motor pair whereby the rotation of the eccentric weights produces a third force vector, in the vertical direction, passing substantially through the vertical center line of the flask.

29. The molding apparatus of claim 28 further including means for separately controlling the first, second and third pair of motors to generate respective first, second and third force vectors on the frame.

30. The molding apparatus of claim 29, wherein said means for controlling includes means for setting the acceleration and duration of acceleration of the flask along each of said first, second and third force vectors.

31. The molding apparatus of claim 29, wherein said means for controlling further includes;

a plurality of accelerometer sensors mounted on the frame, each accelerometer sensor responsive to the acceleration of the frame along one of said force vector directions;

a plurality of speed sensors for determining the rate of rotation of the shaft on each of said motors;

means for comparing data from the sensors indicative of the rotation rate of each motor shaft and the acceleration of the frame in each vector direction, means for defining and displaying a plurality of operating cycle set points for each force vector direction; and means for varying the rate of rotation of each shaft in response to said comparison;

32. A method of compacting filler material between a container and an object in the container during the operation of a production line system, comprising the steps of:

vibrating a frame at a low, idle speed;

positioning the container in the frame and connecting the frame to the container while the frame is vibrating at idle speed;

positioning the object within the container;

depositing filler material into the container;

at a preselected point during the idle speed vibration of the frame increasing the vibration speed of the frame in accordance with a preestablished net force vector sequence to compact the filler material around the object;

reducing the vibration speed of the frame to said idle speed;

disconnecting the container from the frame and removing the container and object therein from the frame while the frame is vibrating at idle speed; and repeating the foregoing steps until all containers have been filled and compacted.

33. The method of compacting filler material of claim 32, wherein the system includes three pairs of motors, each pair generating an oscillating force vector through the frame in one of three mutually perpendicular directions and wherein the step of increasing the vibration speed of the frame includes sequentially generating a plurality of oscillating net force vectors acting on different spatial planes.

34. The method of compacting filler material of claim 32, wherein the step of depositing filler material precedes the step of connecting the frame to the container.

35. The method of compacting filler material of claim 32, wherein the step of depositing filler material follows the step of connecting the frame to the container.

36. The method of compacting filler material of claim 35, wherein the step of increasing the vibration speed occurs during the step of depositing filler material into the container.

37. A method of operating a sand molding compaction system having a plurality of substantially identical rigid mold flasks, each adapted to contain a substantially identical mold pattern and sand, the frame including means for selectively rigidly connecting the frame to at least one of the flasks, means resiliently mounting the frame to a rigid support, at least one pair of motors coupled to the frame for movement with the frame, and means for synchronizing the motors to produce an oscillating net force vector acting on the flask, comprising the steps of:

(a) disconnecting and removing a first flask from the frame;

(b) operating all the motors in synchronized phase relationship at low speed to drive the frame slowly with an idle net vector;

(c) rigidly connecting a second flask to the frame while the frame is driven slowly by the idle vector;

(d) positioning a pattern in sand within the second flask;

(e) operating each motor pair in synchronized phase relationship in a predetermined sequence of high speeds to generate at least one net compaction vector on the frame, for compacting the sand around the pattern in the second flask;

(f) operating all the motors in synchronized phase relationship at low speed to drive the frame slowly;

(g) disconnecting and removing the second flask and contained pattern from the frame while the frame is driven in accordance with step (f); and (h) repeating steps (b) - (g) successively with each of the remaining flasks and patterns.

38. The method of claim 37 wherein the system includes three pairs of motors, each pair generating an oscillating force vector through a set of mutually perpendicular axes, and wherein the step of operating the motor pairs at high speeds includes sequentially generating a plurality of three dimensional net force vectors.

39. The method of claim 37 wherein the step of operating each motor pair in a predetermined sequence of high speeds includes initiating said step at the same condition of the idle net vector generated in step (b), for each flask.

* * * * *